US006074597A

United States Patent [19]

Kwok et al.

[11] Patent Number: 6,074,597

[45] Date of Patent: Jun. 13, 2000

[54] MELTBLOWING METHOD AND APPARATUS

[75] Inventors: Kui-Chiu Kwok, Mundelein; Donald L. Van Erden, Wildwood; Hugh J. Zentmyer, Green Oaks, all of Ill.

[73] Assignee: Illinois Tool Works Inc., Glenview, Ill.

[ * ] Notice: This patent is subject to a terminal disclaimer.

[21] Appl. No.: 09/255,906

[22] Filed: Feb. 20, 1999

Related U.S. Application Data

[63] Continuation of application No. 08/717,080, Oct. 18, 1996, Pat. No. 5,902,540.

[51] Int. Cl.[7] ..... D01D 5/098; D01D 5/14

[52] U.S. Cl. ..... 264/555; 264/103; 264/210.8; 264/211.14; 425/72.2; 425/192 S; 425/463

[58] Field of Search ..... 264/103, 210.8, 264/211.14, 555; 425/72.2, 192 S, 463

[56] References Cited

U.S. PATENT DOCUMENTS

| | | |
|---|---|---|
| Re. 33,158 | 2/1990 | Stouffer et al. . |
| Re. 33,159 | 2/1990 | Bauer . |
| Re. 33,448 | 11/1990 | Bauer . |
| Re. 33,481 | 12/1990 | Zeicker et al. . |
| Re. 33,605 | 6/1991 | Bauer . |
| 2,031,387 | 11/1936 | Schwarz . |
| 2,212,448 | 8/1940 | Modigliani . |
| 2,297,726 | 4/1942 | Stephanoff . |
| 2,628,386 | 2/1953 | Tornberg . |
| 3,038,202 | 6/1962 | Harkenrider . |
| 3,176,345 | 4/1965 | Powell . |
| 3,178,770 | 4/1965 | Willis . |
| 3,192,562 | 7/1965 | Powell . |
| 3,192,563 | 7/1965 | Crompton . |
| 3,204,290 | 9/1965 | Crompton . |
| 3,213,170 | 10/1965 | Erdmenger et al. . |
| 3,253,301 | 5/1966 | McGlaughlin . |
| 3,334,792 | 8/1967 | De Vries et al. . |

(List continued on next page.)

FOREIGN PATENT DOCUMENTS

| | | |
|---|---|---|
| 44-15168 | 7/1969 | Japan . |
| 756907 | 9/1956 | United Kingdom . |
| 1392667 | 4/1975 | United Kingdom . |
| WO9315895 | 8/1993 | WIPO . |

OTHER PUBLICATIONS

Nonwovens World Magazine, "Meltblown Technology Today", 1989, pp. 1–158.

The New Non–Wovens World, "Developments in Melt Blowing Technology", Summer 1993, pp. 73–82.

Gregory F. Ward, "Micro–Denier Nonwoven Process and Fabrics", on or about Oct. 17, 1997, pp. 1–9.

Edward J. McNally et al., J&M Laboratories, "Durafiber/Durastitch Adhesives Applications Method featuring Solid State Application Technology" disclosed Sep. 8, 1997 at Inda–Tec 97 Meeting, Cambridge MA, pp. 26.1–26.8.

Scott R. Miller, Beyond Meltblowing: Process Refinement in Microfibre Hot melt adhesive Technology, Edana 1998 International Nonwovens Symposium, 11 pgs.

Rajiv S. Rao et al., "Vibration and Stability in the Melt Blowing Process", Ind. Eng. Chem. Res., 1993, 32, 3100–3111.

*Primary Examiner*—Leo B. Tentoni

[57] ABSTRACT

A meltblowing method and apparatus for dispensing an adhesive through a plurality of first orifices of a die assembly fabricated from a plurality of laminated members to form a plurality of adhesive flows at a first velocity, and dispensing air through a plurality of second orifices in the die assembly to form a plurality of air flows at a second velocity. The plurality of first and second orifices arranged in an alternating series so that each of the plurality of first orifices is flanked on substantially opposing sides by one of the plurality of second orifices, wherein the plurality of first and second orifices are oriented to direct non-convergently the plurality of adhesive flows and the plurality of air flows. The plurality of adhesive flows are drawn and attenuated by the plurality of air flows at the second velocity greater than the first velocity of the plurality of adhesive flows, wherein the plurality of adhesive flows are attenuated to form a plurality of adhesive filaments useable for the production of bodily fluid absorbing hygienic articles.

54 Claims, 8 Drawing Sheets

U.S. PATENT DOCUMENTS 3,380,128 4/1968 Cremer et al. .
3,488,806 1/1970 De Cecco et al. .
3,492,692 2/1970 Soda et al. .
3,501,805 3/1970 Douglas, Jr. et al. .
3,613,170 10/1971 Soda et al. .
3,650,866 3/1972 Prentice .
3,704,198 11/1972 Prentice .
3,755,527 8/1973 Keller et al. .
3,825,379 7/1974 Lohkamp et al. .
3,849,241 11/1974 Butin et al. .
3,861,850 1/1975 Wallis .
3,874,886 4/1975 Levecque et al. .
3,888,610 6/1975 Brackmann et al. .
3,920,362 11/1975 Bradt .
3,923,444 12/1975 Esper et al. .
3,942,723 3/1976 Langdon .
3,947,537 3/1976 Buntin et al. .
3,970,417 7/1976 Page .
3,978,185 8/1976 Buntin et al. .
3,981,650 9/1976 Page .
4,007,625 2/1977 Houben et al. .
4,015,963 4/1977 Levecque et al. .
4,015,964 4/1977 Levecque et al. .
4,050,866 9/1977 Kilsdonk .
4,052,002 10/1977 Stouffer et al. .
4,052,183 10/1977 Levecque et al. .
4,100,324 7/1978 Anderson et al. .
4,145,173 3/1979 Pelzer et al. .
4,151,955 5/1979 Stouffer .
4,185,981 1/1980 Ohsato et al. .
4,189,455 2/1980 Raganato et al. .
4,277,436 7/1981 Shah et al. .
4,300,876 11/1981 Kane et al. .
4,340,563 7/1982 Appel et al. .
4,359,445 11/1982 Kane et al. .
4,380,570 4/1983 Schwarz .
4,457,685 7/1984 Huang et al. .
4,526,733 7/1985 Lau .
4,596,364 6/1986 Bauer .
4,645,444 2/1987 Lenk et al. .
4,652,225 3/1987 Dehennau et al. .
4,694,992 9/1987 Stouffer .
4,708,619 11/1987 Balk .
4,746,283 5/1988 Hobson .
4,747,986 5/1988 Chao .
4,785,996 11/1988 Ziecker et al. .
4,812,276 3/1989 Chao .
4,818,463 4/1989 Buehning .
4,818,464 4/1989 Lau .
4,826,415 5/1989 Mende .
4,874,451 10/1989 Boger et al. .
4,889,476 12/1989 Buehning .
4,905,909 3/1990 Woods .
4,923,706 5/1990 Binley et al. .
4,949,668 8/1990 Heindel et al. .
4,955,547 9/1990 Woods .
4,983,109 1/1991 Miller et al. .
5,013,232 5/1991 Way .
5,017,116 5/1991 Carter et al. .
5,035,361 7/1991 Stouffer .
5,065,943 11/1991 Boger et al. .
5,066,435 11/1991 Lorenz et al. .
5,067,885 11/1991 Stevenson et al. .
5,069,853 12/1991 Miller .
5,094,792 3/1992 Baran .
5,098,636 3/1992 Balk .
5,114,752 5/1992 Hall .
5,124,111 6/1992 Keller et al. ..... 264/555
5,129,585 7/1992 Bauer .
5,145,689 9/1992 Allen et al. .
5,165,940 11/1992 Windley .
5,169,071 12/1992 Boger et al. .
5,260,003 11/1993 Nyssen et al. .
5,269,670 12/1993 Allen et al. .
5,342,647 8/1994 Heindel et al. .
5,354,378 10/1994 Hauser et al. .
5,407,619 4/1995 Maeda et al. .
5,409,733 4/1995 Boger et al. .
5,418,009 5/1995 Raterman et al. .
5,421,921 6/1995 Gill et al. .
5,421,941 6/1995 Allen et al. .
5,423,935 6/1995 Benecke et al. .
5,429,840 7/1995 Raterman et al. .
5,445,509 8/1995 Allen et al. .
5,458,291 10/1995 Brusko et al. .
5,458,721 10/1995 Raterman .
5,478,224 12/1995 McGuffey .
5,503,784 4/1996 Balk .
5,524,828 6/1996 Raterman et al. .
5,533,675 7/1996 Benecke et al. .
5,540,804 7/1996 Raterman .
5,605,706 2/1997 Allen et al. .
5,618,347 4/1997 Clare et al. .
5,618,566 4/1997 Allen et al. .
5,620,139 4/1997 Ziecker .
5,667,750 9/1997 Nohr et al. ..... 264/555
5,679,379 10/1997 Fabbricante et al. .
5,862,986 1/1999 Bolyard, Jr. et al. .
5,902,540 5/1999 Kwok .
5,904,298 5/1999 Kwok et al. .

MELTBLOWING METHOD AND APPARATUS

CROSS REFERENCE TO RELATED APPLICATIONS

The present application is a continuation of U.S. application Ser. No. 08/717,080, filed on Oct. 18, 1996, now U.S. Pat. No. 5,902,540, issued on May 11, 1999, which is fully incorporated herein by reference.

BACKGROUND OF THE INVENTION

The invention relates generally to meltblowing processes and to die assemblies for practicing meltblowing processes, and more particularly to die assemblies with a plurality of adhesive dispensing orifices flanked on each side by air dispensing orifices, wherein adhesive flows from the plurality of adhesive dispensing orifices are drawn and attenuated by relatively high velocity, high temperature air flows from the air dispensing orifices to form adhesive filaments.

Meltblowing is a process of forming fibers or filaments by drawing and attenuating a first fluid flow, like molten thermoplastic, with shear forces from an adjacent second fluid flow, like heated air, at high velocity relative to the first fluid flow. These meltblown filaments may be continuous or discontinuous, and range in size between several tenths of a micron and several hundreds of microns depending on the meltblown material and requirements of a particular application. The applications for meltblowing processes include, among others, the formation of non-woven fabrics and the dispensing of meltblown adhesive materials for bonding substrates in the production of a variety of bodily fluid absorbing hygienic articles like disposable diapers and incontinence pads, sanitary napkins, patient underlays, and surgical dressings.

In U.S. Pat. No. 5,145,689 entitled "Meltblowing Die" issued on Sep. 8, 1992 to Allen et al., for example, an elongated die assembly includes a triangular die tip defined by converging surfaces that form an apex with a plurality of orifices arranged in a series therealong. A continuous air passage formed by air plates disposed along and spaced apart from the converging surfaces of the die tip directs converging sheets of high temperature, high velocity air along the converging surfaces of the die tip toward the apex where the high velocity air draws and attenuates polymer flows dispensed from the plurality of orifices. The U.S. Pat. No. 5,145,689 also discloses an actuatable valve assembly located upstream of the plurality of orifices to selectively control the polymer flow to the orifices in the die tip.

The inventors of the present invention recognize that compressing and heating air required for forming meltblown adhesives and other filaments is an expensive aspect of the meltblowing process. The inventors recognize also that drawing and attenuating fluid dispensed from a series of orifices in a die with converging air flow sheets disposed along opposing sides of the series of orifices is an inefficient configuration for meltblowing processes that require substantial amounts of compressed air, which is costly. More specifically, a substantial portion of each air sheet contributes very little to the meltblowing process since only those portions of the air sheet proximate the opposing flanking sides of the individual fluid flows has any significant affect on the drawing and attenuation of the dispensed fluid. Also, only the shear component of the converging air flow sheets, which is parallel to the dispensed fluid flow direction, contributes to the drawing and attenuation of the dispensed fluid.

The compressive component of the converging air flow sheets, which flows perpendicular to the dispensed fluid flow direction, does not contribute to the drawing and attenuation of the dispensed fluid. The inventors recognize further that maximizing the shear component of the air flow will maximize the rate at which the meltblown material is drawn and attenuated and reduce the required amounts of compressed air, which results in reduced production costs.

The inventors of the present invention recognize that any residual fluid along a fluid supply conduit between an actuatable fluid supply control valve and a fluid dispensing orifice has a tendency to continue to flow from the fluid dispensing orifice after the fluid supply has been terminated. In applications that require accurate dispensing of a meltblown fluid including the application of meltblown adhesives onto substrates, however, any continued fluid flow from the fluid orifice after the fluid supply is terminated is highly undesirable. The inventors recognize also that it is necessary in many meltblown adhesive applications, including the manufacture of bodily fluid absorbing hygienic articles, to uniformly produce and apply the meltblown filaments. More specifically, it is necessary to apply a consistent layer of meltblown material onto a substrate or other surface and to produce a well defined interface or boundary between areas covered and areas not covered by the meltblown material. In the production of bodily fluid absorbing hygienic articles, for example, accurate control over the application of meltblown adhesives onto specific areas of a substrate is absolutely necessary since only designated portions of the substrate require bonding whereas other areas either do not require bonding or are discarded as waste.

The inventors of the present invention recognize further that prior art manufacture and fabrication of meltblowing dies limits the scope meltblowing applications for which the dies may be used. More specifically, many meltblowing dies require precision machining techniques to fabricate the often very small diameter fluid dispensing orifices and other features of the die. For some applications the die fabrication requirements are at the limits of existing technologies, and in many other applications the die fabrication requirements are cost prohibitive.

In view of the discussion above among other considerations, there exists a demonstrated need for an advancement in the art of meltblown processes and apparatuses for practicing meltblowing processes.

It is therefore an object of the invention to provide novel meltblowing methods and novel apparatuses for practicing meltblowing methods that overcome problems in the prior art.

It is also an object of the invention to provide novel meltblowing methods and apparatuses that are economical and useable for applying meltblown adhesives onto substrates in the production of bodily fluid absorbing hygienic articles.

It is another object of the invention to provide novel meltblowing methods and apparatuses that reduce amounts of fluid required for forming meltblown filaments, and in particular for reducing amounts of air required for drawing and attenuating meltblown adhesive filaments.

It is another object of the invention to provide novel meltblowing methods and apparatuses for eliminating residual fluid flow from fluid dispensing orifices of a body member after terminating fluid supplied to the orifices.

It is another object of the invention to provide novel meltblowing methods and apparatuses for controlling application of meltblown filaments, and more particularly for selectively controlling dispensed fluid mass flow rates, and for selectively controlling dispensed fluid vacillation parameters, and for selectively controlling patterns of meltblown filaments applied onto a substrate including edge definition of the meltblown filaments.

It is yet another object of the invention to provide a novel meltblowing die assembly comprising a plurality of laminated members for distributing first and second fluids to corresponding first and second orifices arranged in an alternating series, wherein each of the first orifices is flanked on both substantially opposing sides by one of the second orifices, and wherein the first and second fluid flows are directed substantially non-convergently.

It is still another object of the invention to provide a novel meltblowing die assembly comprising a plurality of laminated members or plates for distributing first and second fluids to corresponding first and second orifices arranged in an alternating series of first and second orifices, wherein each first orifice and a second orifice disposed on both substantially opposing sides of the first orifice form an array of fluid dispensing orifices, and wherein a plurality of at least two arrays are arranged either collinear, or parallel, or non-parallel to each other in the meltblowing die assembly.

It is another object of the invention to provide a novel meltblowing die assembly mountable on a die adapter assembly which supplies fluids to the die assembly, wherein a plurality of at least two die adapter assemblies are arranged adjacently to form an array of adjacent die assemblies.

These and other objects, features and advantages of the present invention will become more fully apparent upon consideration of the following Detailed Description of the Invention with the accompanying Drawings, which may be disproportionate for ease of understanding, wherein like structure and steps are referenced by corresponding numerals and indicators.

DETAILED DESCRIPTION OF THE INVENTION

Figure 1:
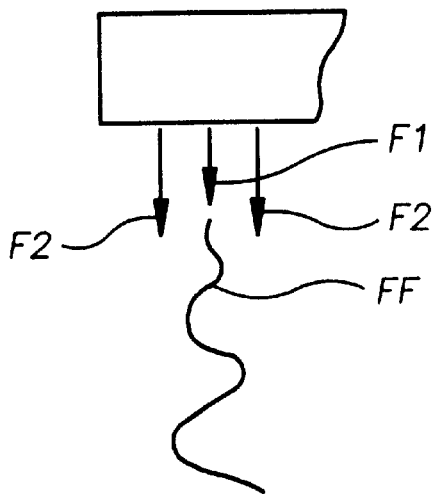
FIG. 1 is a diagrammatic view of an exemplary meltblowing process according to one aspect of the present invention.

FIG. 1 is a diagrammatic view of a meltblowing process or method wherein a first fluid is dispensed to form a fluid flow F1 at a first velocity and a second fluid is dispensed to form separate second fluid flows F2 at a second velocity along substantially opposing flanking sides of the first fluid flow F1. According to this configuration, the first fluid flow F1 is located between the separate second fluid flows F2, wherein the substantially opposing sides of the first fluid flow F1 are each flanked by the second fluid flows F2 to form an array of fluid flows as shown in FIG. 1. The second velocity of the second fluid flows F2 is greater than the first velocity of the first fluid flow F1 so that the second fluid flows F2 draw and attenuate the first fluid flow F1 to form a first fluid filament FF. The length of the arrows F1 and F2 is indicative of, though not proportional to, the relative velocities therebetween. The first fluid flow F1 and the second fluid flows F2 are directed generally non-convergently. FIG. 1 shows the first fluid flow F1 and flanking second fluid flows F2 directed in parallel, which maximizes the drawing effect of the shear component of the second fluid flows F2 on the first fluid flow F1. In other embodiments, however, it may be advantageous to divergently direct the first fluid flow F1 and the second fluid flows F2 to control application or dispensing of the fluid filament FF without substantially adversely affecting the shear component of the second fluid flows F2 available for drawing the first fluid flow F1.

The method may be practiced, more generally, by dispensing the first fluid to form a plurality of first fluid flows F1 at the first velocity and dispensing the second fluid to form a plurality of second fluid flows F2 at the second velocity, wherein the plurality of first fluid flows F1 and the plurality of second fluid flows F2 are arranged in an alternating series so that each of the plurality of first fluid flows F1 is flanked on substantially opposing sides by one of the plurality of second fluid flows F2.

According to this configuration, each of the plurality of first fluid flows F1 in the alternating series has one of the plurality of second fluid flows F2 on substantially opposing sides of the first fluid flow F1. The second velocity of the plurality of second fluid flows F2 is greater than the first velocity of the plurality of first fluid flows F1 so that the plurality of second fluid flows F2 draws and attenuates the plurality of first fluid flows F1 to form a plurality of first fluid filaments FF. The plurality of first fluid flows F1 and the plurality of second fluid flows F2 along the substantially opposing flanking sides of the first fluid flows F1 are directed generally non-convergently as discussed above. According to this mode of practicing the invention, the arrangement of the plurality of first and second fluid flows in an alternating series utilizes relatively effectively the shear component of the plurality of second fluid flows F2 for drawing and attenuating the plurality of first fluid flows F1 to form the plurality of first fluid filaments.

FIG. 1 shows the first fluid flow F1 including the first fluid filament FF vacillating under the effect of the flanking second fluid flows F2, which vacillation is attributable generally to instability of the fluid flows. The first fluid flow vacillation is characterizeable generally by an amplitude parameter and a frequency parameter, which are variable. The vacillation may be controlled, for example, by varying a spacing between the first fluid flow F1 and one or more of the flanking second fluid flows F2, or by varying an amount of one or more of the second fluid flows F2, or by varying a velocity of one or more of the second fluid flows F2. The frequency parameter of the vacillation is controlled generally by varying a velocity of the second fluid flows F2 relative to the velocity of the first fluid flow F1. The amplitude of the vacillation is controlled generally by varying a spacing between the first fluid flow F1 and the second fluid flows F2, or by varying the flow volummes or quantity of the second fluid flows F2. The symmetry of the vacillation is controlled generally by varying one of the second fluid flows F2 relative to the other of the second fluid flows F2. Control over vacillation symmetry is an effective means for controlling the edge profile or edge definition of the first fluid filament in some applications as further discussed below. These methods for controlling vacillation parameters of the first fluid flow F1 are also applicable to controlling vacillation parameters of a plurality of first fluid flows and the corresponding plurality of first fluid filaments.

Figure 2A:
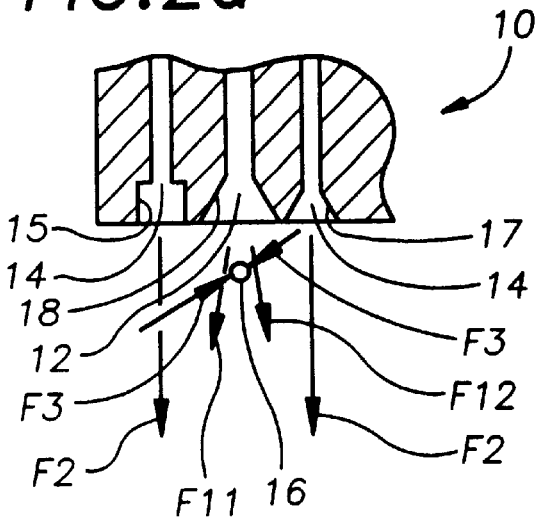
FIG. 2*a* is a partial sectional view of a meltblowing die for practicing meltblowing processes according to several other aspects of the present invention.
Figure 2B:
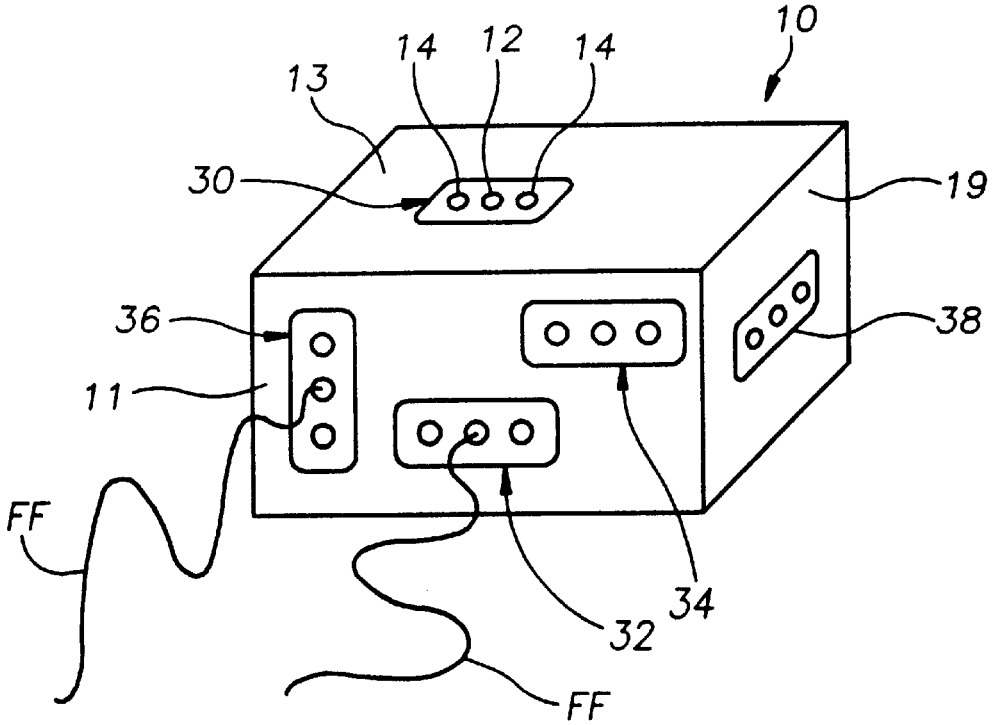
FIG. 2*b* is a perspective view of a meltblowing die having a plurality of arrays of fluid dispensing orifices arranged in configurations according to several exemplary embodiments of the invention, wherein each array includes a first orifice flanked on both substantially opposing sides by a second orifice.

FIG. 2*a* is a partial sectional view of an exemplary meltblowing die or body member 10 for practicing processes according to the present invention. Generally, the first fluid is dispensed from a first orifice 12 of the body member to form the first fluid flow F1, and the second fluid is dispensed from second orifices 14 to form separate second fluid flows F2 flanking substantially opposing sides of the first fluid flow F1 to form an orifice array 30, one of which is referenced in FIG. 2*b*. More generally, the body member 10 may include a plurality of first orifices 12 each flanked on substantially opposing sides by one of a plurality of second orifices 14 to form the alternating series of first and second fluid flows discussed above. And still more generally, the body member 10 may include a plurality of at least two arrays of orifices each formed by a first orifice and second orifices on substantially opposing sides of the first orifice. FIG. 2*b*, for example, shows a body member 10 having plurality of at least two orifice arrays 30 in a several exemplary configurations. According to one configuration, a common surface 11 of the body member 10 includes a first orifice array 32 and a second orifice array 34 arranged in parallel, though not necessarily collinear, to provide staggered first fluid filaments FF that vacillate in substantially parallel planes, only one of which is shown for clarity. In a more particular configuration, the fluid filaments FF produced by the staggered orifice arrays 32 and 34 may be controlled to overlap slightly. In another configuration, one orifice array 36 is oriented at an angle relative to one of the other orifice arrays 32 or 34 to provide first fluid filaments FF that vacillate in intersecting planes as shown. And in another configuration, one or more orifice arrays 30 and 38 are located on other surfaces 13 and 19 of the body member 10 relative to other orifice arrays 32, 34, and 36 to provide a three dimensional fluid filament distribution. These exemplary basic configurations may also be combined to produce still other configurations. FIG. 2*a* shows one of the second orifices recessed in an aperture 15 of the body member 10 relative to the first orifice 12. According to this configuration, the recessed second orifice 14 prevents upward migration of first fluid flow from the first orifice 12 into the second orifice 14 to prevent obstruction thereof. In one embodiment, both of the plurality of second orifices 14 on each substantially opposing side of the first orifice 12 is recessed relative to the first orifice 12. FIG. 2*a* also shows the aperture 15 having an increasing taper extending away from the second orifice 14, which forms a tapered aperture 17. According to this alternative configuration, the tapered aperture 17 prevents upward migration of first fluid flow F1 from the first orifice 12 into the second orifice 14, as discussed above. The tapered aperture 17 also modifies the second fluid flow F2, for example, by broadening or increasing the cross sectional area of the second fluid flow F2. In another embodiment, both of the plurality of recesses 15 on substantially opposing sides of the first orifice 12 has an increasing taper to form a tapered aperture 17 as discussed above. Generally, the first and second orifices 12 and 14 of the body member 10 may have any cross sectional shape including circular, rectangular and generally polygonal shapes.

In one mode of practicing the invention shown in FIG. 2*a*, a high pressure zone 16 is generated proximate an output of the first orifice 12 with converging separate third fluid flows F3 to block residual first fluid flow from the first orifice 12 after a first fluid supply has been terminated. According to this aspect of the invention, the converging third fluid flows F3 are convergently directed from either the same side or from opposing sides of the series of first and second fluid flows F1 and F2 so that the converging third fluid flows F3 meet to form the high pressure zone 16 proximate the output of the first orifice 12. Alternatively, the high pressure zone 16 may be formed by deflecting or otherwise converging the second fluid flows F2, wherein the deflected second fluid flows F2 form the converging third fluid flows F3. In the preferred configuration, the converging third fluid flows F3 that form the high pressure zone 16 proximate the output of the first orifice 12 do not have a component of third fluid flow F3 in the direction of the first fluid flow F1 to ensure that residual first fluid flow is blocked. This process of converging third fluid flows F3 to form high pressure zones 16 proximate the first orifice 12 for blocking residual first fluid flow after the first fluid supply has been terminated is also applicable to blocking residual first fluid flow from each of a plurality of first orifices, wherein a corresponding high pressure zone 16 is generated proximate an output of each of the plurality of first orifices.

In another mode of practicing the invention shown in FIG. 2*a*, separate first fluid flows F11 and F12 are formed from the first orifice 12 by dispensing the first fluid through an increasing aperture 18 of the first orifice 12 and drawing the first fluid flow with the separate second fluid flows F2 at a second velocity greater than the first velocity of the first fluid flow, wherein the separate first fluid flows F11 and F12 form corresponding separate first fluid filaments. According to this aspect of the invention, the flanking second fluid flows F2 create corresponding low pressure zones on substantially opposing sides of the first fluid flow which tend to separate the first fluid flow emanating from the increasing aperture 18 of the first orifice 12. This process is also applicable to forming separate first fluid flows from one or more of a plurality of first orifices of a body member wherein a corresponding one or more of the first orifices 12 has an increasing aperture 18 as discussed above.

Another mode of forming separate first fluid flows F11 and F12 from the first orifice 12 includes generating a high pressure zone 16 proximate an output of the first orifice 12 with converging fourth fluid flows and drawing the first fluid flows F11 and F12 with the separate second fluid flows F2 at a second velocity greater than the first velocity of the first fluid flow, wherein the separate first fluid flows F11 and F12 form corresponding separate first fluid filaments. According to this aspect of the invention, the fourth fluid flows may be convergently directed from opposing sides of the series formed by the first and second fluid flows, or the array, so that the converging fourth fluid flows meet to form the high pressure zone 16 as discussed above. The first orifice 12 does not require an increasing aperture 18 for practicing this alternative aspect of the invention, which is also applicable to forming separate first fluid flows from each of a plurality of first orifices of a body member wherein a corresponding high pressure zone 16 is generated proximate an output of each of the plurality of first orifices.

According to another aspect of the invention, first fluid is dispensed from the plurality of first orifices to form the plurality of first fluid flows at substantially the same mass flow rate, and second fluid is dispensed from the plurality of second orifices to form the plurality of second fluid flows at substantially the same mass flow rate. According to a related aspect of the invention, the mass flow rates of one or more of the plurality of first fluid flows is controllable by varying either or both the size of the corresponding first orifice 12 and the fluid pressure across the corresponding first orifice 12, wherein the corresponding one or more first fluid flows have different mass flow rates. The mass flow rates of one or more of the plurality of second fluid flows is similarly controllable. And according to a related aspect of the invention, the meltblowing die or body member having a plurality of arrays or a plurality of first orifices and a plurality of second orifices arranged in an alternating series, as discussed above, also includes a first means for substantially uniformly distributing first fluid supplied to one or more of the plurality of first orifices 12 to form the plurality of first fluid flows F1 at the first velocity and at substantially the same mass flow rate, and a second means for substantially uniformly distributing second fluid supplied to one or more of the plurality of second orifices 14 to form the plurality of second fluid flows F2 at the second velocity and at substantially the same mass flow rate. According to this aspect of the invention, the dispensing of the plurality first fluid filaments formed by drawing and attenuating the plurality of first fluid flows from the plurality of first orifices of the die assembly may be controlled by controlling the distribution of first fluid to the plurality of first orifices 12.

Figure 3A:
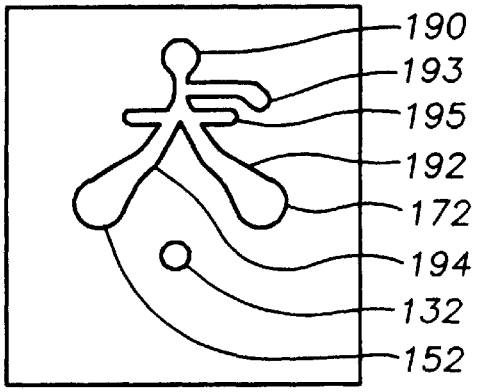
FIGS. 3*a*–3*t* and 3*z* represent individual plates of a die assembly or body member according to an exemplary embodiment of the invention.
Figure 3B:
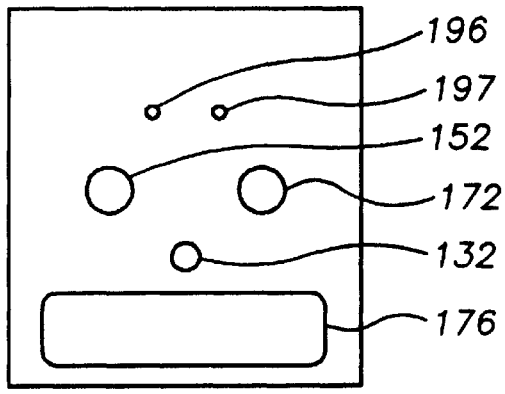
Figure 3D:
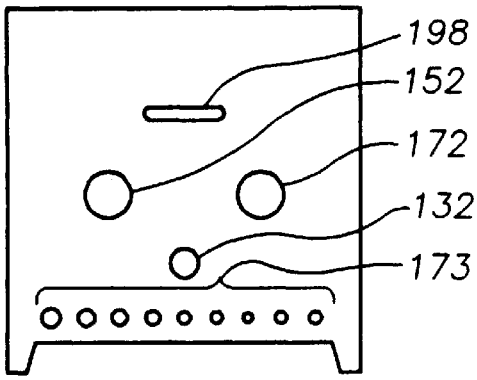
Figure 3C:
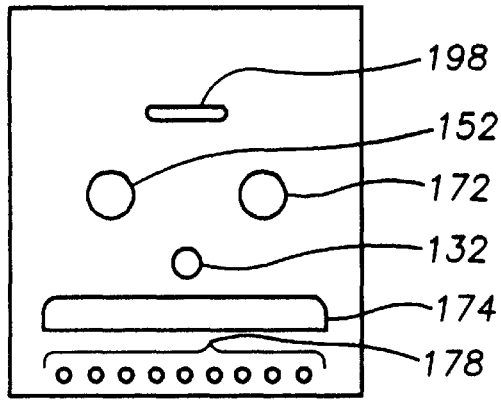
Figure 3E:
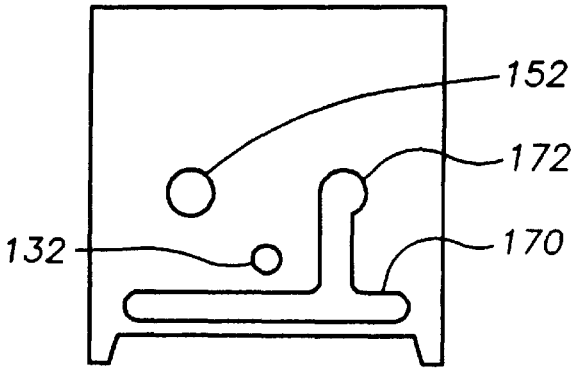
Figure 3F:
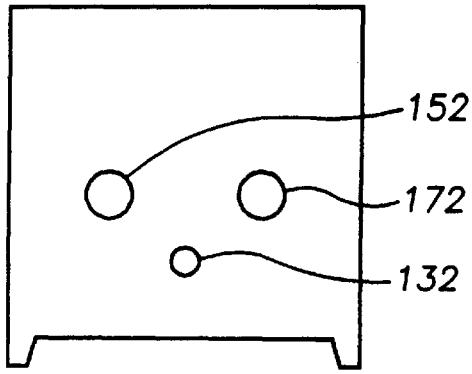
Figure 3H:
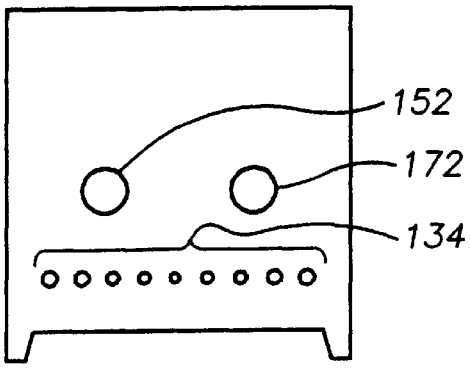
Figure 3G:
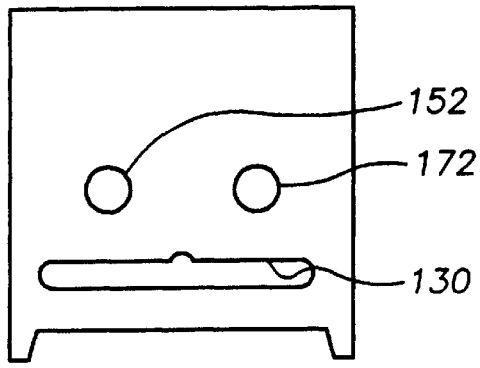
Figure 3I:
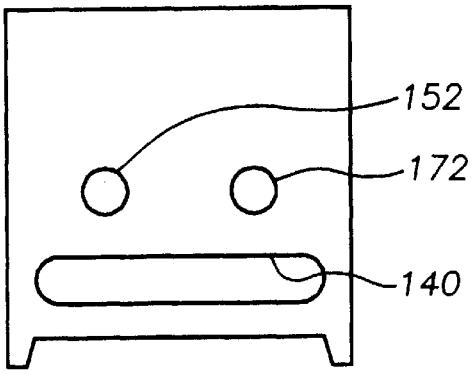
Figure 3J:
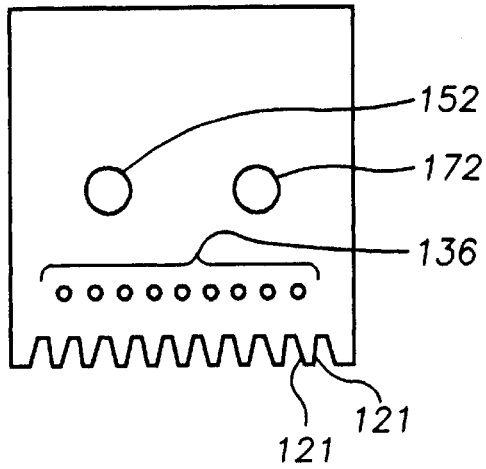
Figure 3L:
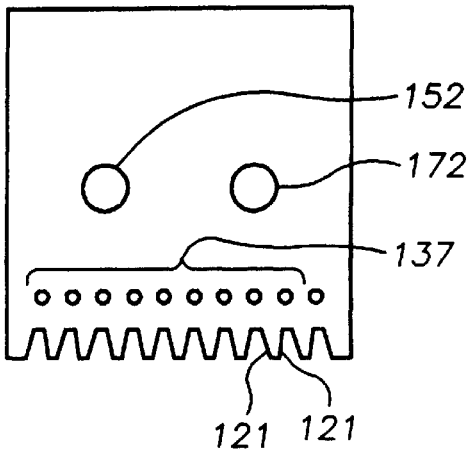
Figure 3K:
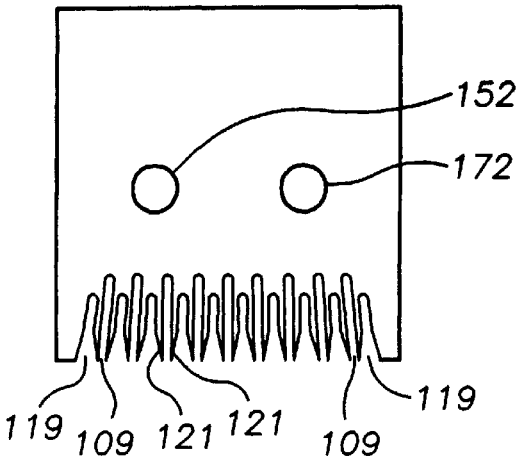
Figure 3M:
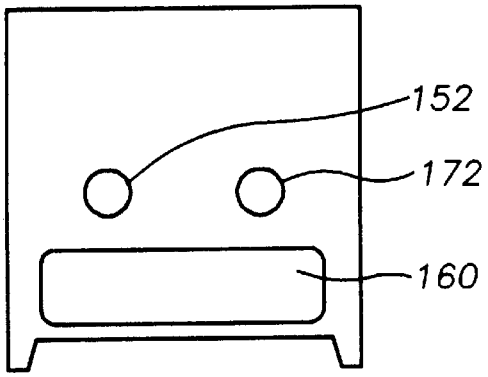
Figure 3N:
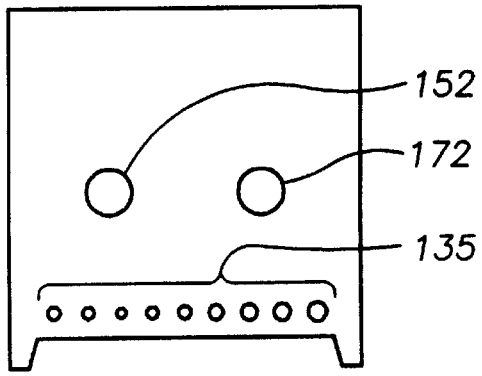
Figure 3P:
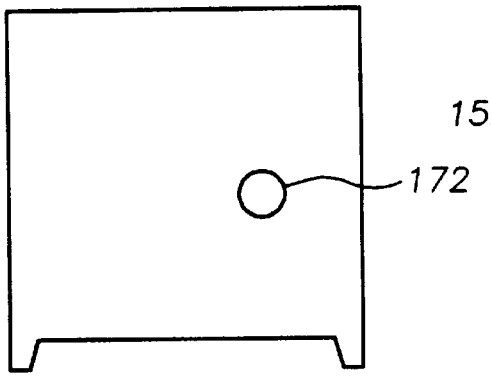
Figure 3O:
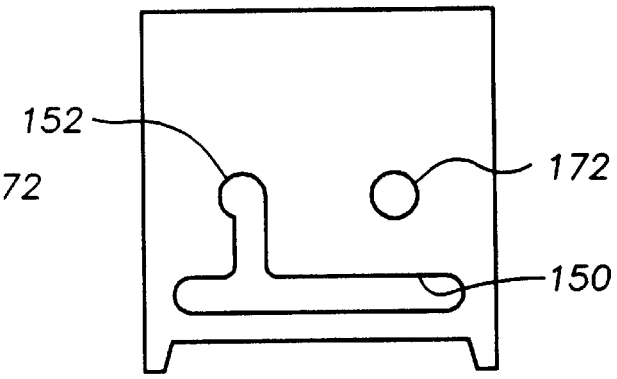
Figure 3Q:
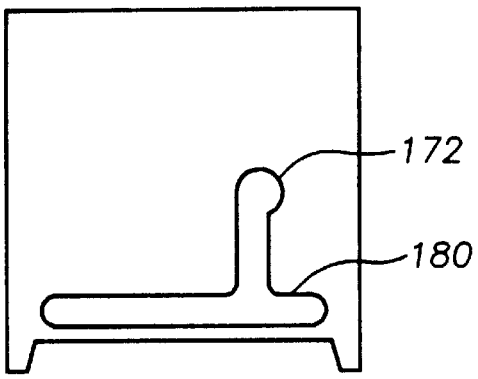
Figure 3R:
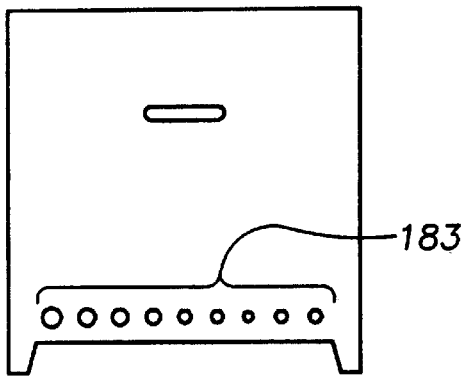
Figure 3T:
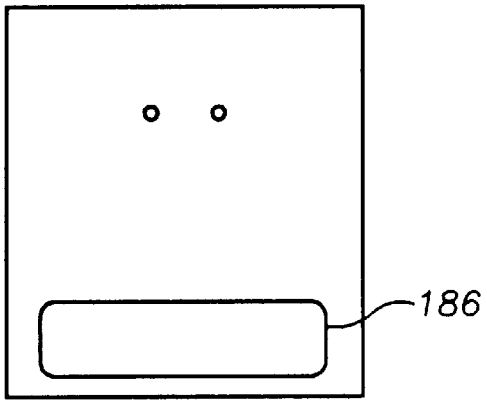

In FIGS. 3*a*–3*t*, 3*z*, 4*a*–4*f* and 5, the exemplary die assembly 100 comprises a plurality of laminated members or plates. The plates of FIGS. 3*a*–3*t*, are assembled one on top of the other beginning with the plate in FIG. 3*a* and ending with plate 3*t*. The plates of FIGS. 3*f*–3*k* correspond to the plates in FIGS. 4*a*–4*f*, respectively, and the plates of FIGS. 3*f*–3*l* corresponds to the assembly of FIG. 5, which shows an alternating series of the plurality of first and second orifices 110 and 120 as discussed above. The first and second fluids supplied to the die assembly 100 are distributed to the plurality of first and second orifices 110 and 120 as follows. The first fluid is supplied from a first restrictor cavity inlet 132 in the plate of FIG. 3*f*, also shown in FIG. 4*a*, to a first restrictor cavity 130 in the plate of FIG. 3*g*, also shown in FIG. 4*b*, through a plurality of passages 134 in the plate of FIG. 3*h*, also shown in FIG. 4*c*, and into first accumulator cavity 140 in the plate of FIG. 3*i*, also shown in FIG. 4*d*, where the first fluid is accumulated. The first fluid is then supplied from the accumulator cavity 140 through a plurality of passages 136 in the plate of FIG. 3*j*, also shown in FIG. 4*e*, to a plurality of first slots 109 in the plate of FIG. 3*k*, also shown in FIG. 4*f*. The plurality of first slots 109 form the plurality of first orifices 110 shown in FIG. 5 when the plate of FIG. 3*k* is disposed between the plate of FIG. 3*j* and the plate of FIG. 3*l*. The second fluid is supplied from a second restrictor cavity inlet 152 in the plates of FIGS. 3*f*–3*o* to a second restrictor cavity 150 in the plate of FIG. 3*o*, through a plurality of passages 135 in the plate of FIG. 3*n*, and into a second accumulator cavity 160 in the plate of FIG. 3*m* where the second fluid is accumulated. The second fluid accumulated in the accumulator cavity 160 is then supplied through a plurality of passages 137 in the plate of FIG. 3*i* to a plurality of second slots 119 in the plate of FIG. 3*k*.

According to another aspect of the invention, the first fluid mass flow rate through each of the passages 134 is controlled by varying a size of the passages 134. In the exemplary embodiment of FIGS. 3*a*–3*t*, the first fluid supplied from the first restrictor cavity 130 is substantially uniformly distributed and supplied to the first accumulator cavity 140 by the plurality passages 134 having varying sizes to compensate for decreasing pressure along portions of the first restrictor cavity outlet and to provide substantially the same first fluid mass flow rate through each of the passages 134. The substantially uniformly distributed first fluid is accumulated in the first accumulator cavity 140 and supplied through a plurality of passages 136 at the first accumulator cavity outlet to the plurality of first orifices 110. And the plurality of first orifices 110, which are substantially the same size, dispense the uniformly distributed first fluid to form the plurality of first fluid flows at the first velocity and at substantially the same mass flow rate. Similarly, the second fluid supplied from the second restrictor cavity 150 is substantially uniformly distributed and supplied to the second accumulator cavity 160 by the plurality or passages 135 having varying sizes to compensate for decreasing pressure along portions of the second restrictor cavity outlet and to provide substantially the same second fluid mass flow rate through each of the passages 135. The substantially uniformly distributed second fluid is accumulated in the second accumulator cavity 160 and supplied through a plurality of passages 137 at the second accumulator cavity outlet to the plurality of second orifices 120. And the plurality of second orifices 120, which are substantially the same size, dispense the uniformly distributed second fluid to form the plurality of second fluid flows at the second velocity and at substantially the same mass flow rate.

In alternative embodiments, however, the fluid mass flow rates through any one or more of the orifices 110 and 120 may be selectively varied by varying a size of the corresponding orifices. And in an alternative or cumulative configuration, the fluid mass flow rate through any one or more of the first and second orifices 110 and 120 may be selectively varied by varying a pressure across the corresponding orifices. The pressure across an orifice may be decreased, for example, by forming an additional cavity, which causes a fluid pressure drop, along the fluid flow path to the selected orifice. If the die assembly is fabricated from a plurality of individual plates as discussed above, the additional cavity or cavities may be formed readily in one of the existing plates or in an additional plate.

Figure 5:
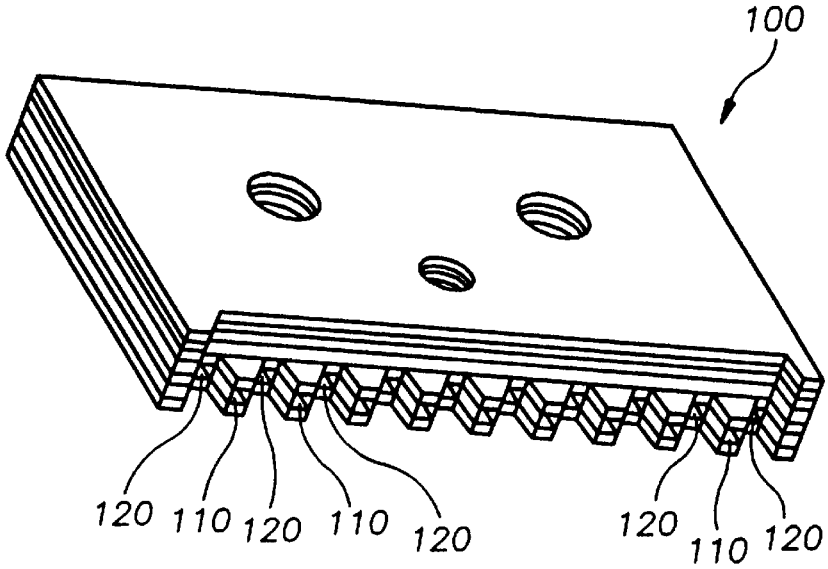
FIG. 5 is a perspective view of an exemplary partially assembled die assembly comprising several individual plates of FIG. 3.

FIG. 5 shows the plurality of second slots 119, which form the plurality of second orifices 120, disposed in a recess with a tapered aperture 121 relative to the plurality of first slots 109, which form the plurality of first orifices 110. As discussed above, this configuration reduces the tendency of the first fluid flows to migrate from the plurality of first orifices 110 back upward and into the plurality of second orifices 120 and also modifies the plurality of second fluid flows. To obtain this configuration, the plates of FIGS. 3*j*–3*l* have corresponding tapered slots 121 to provide the tapered aperture when the plates of FIGS. 3*j*–3*l* are assembled. In alternative embodiments, however, the plates of FIGS. 3*j*–3*l* may have slot configurations to provide any combination of the first and second orifice configurations discussed above with respect to FIG. 2*a*.

According to another aspect of the invention, the die assembly 100 includes a third means for generating a high pressure zone proximate an output of each of the plurality of first orifices 110 with converging third fluid flows, wherein the high pressure zone blocks residual fluid flow from the corresponding first orifice after terminating a supply of first fluid to the first orifice as discussed above. And according to a related aspect of the invention, the plurality of second fluid flows are diverted to form the high pressure zones as discussed below.

Figure 3S:
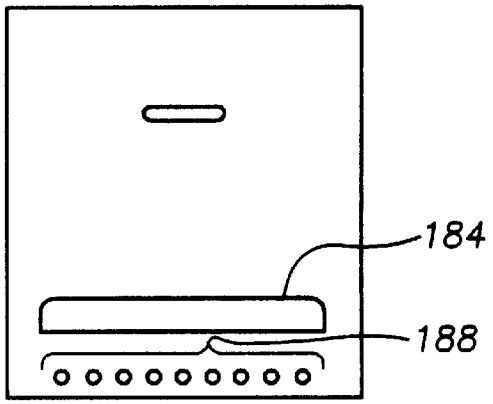
Figure 6:
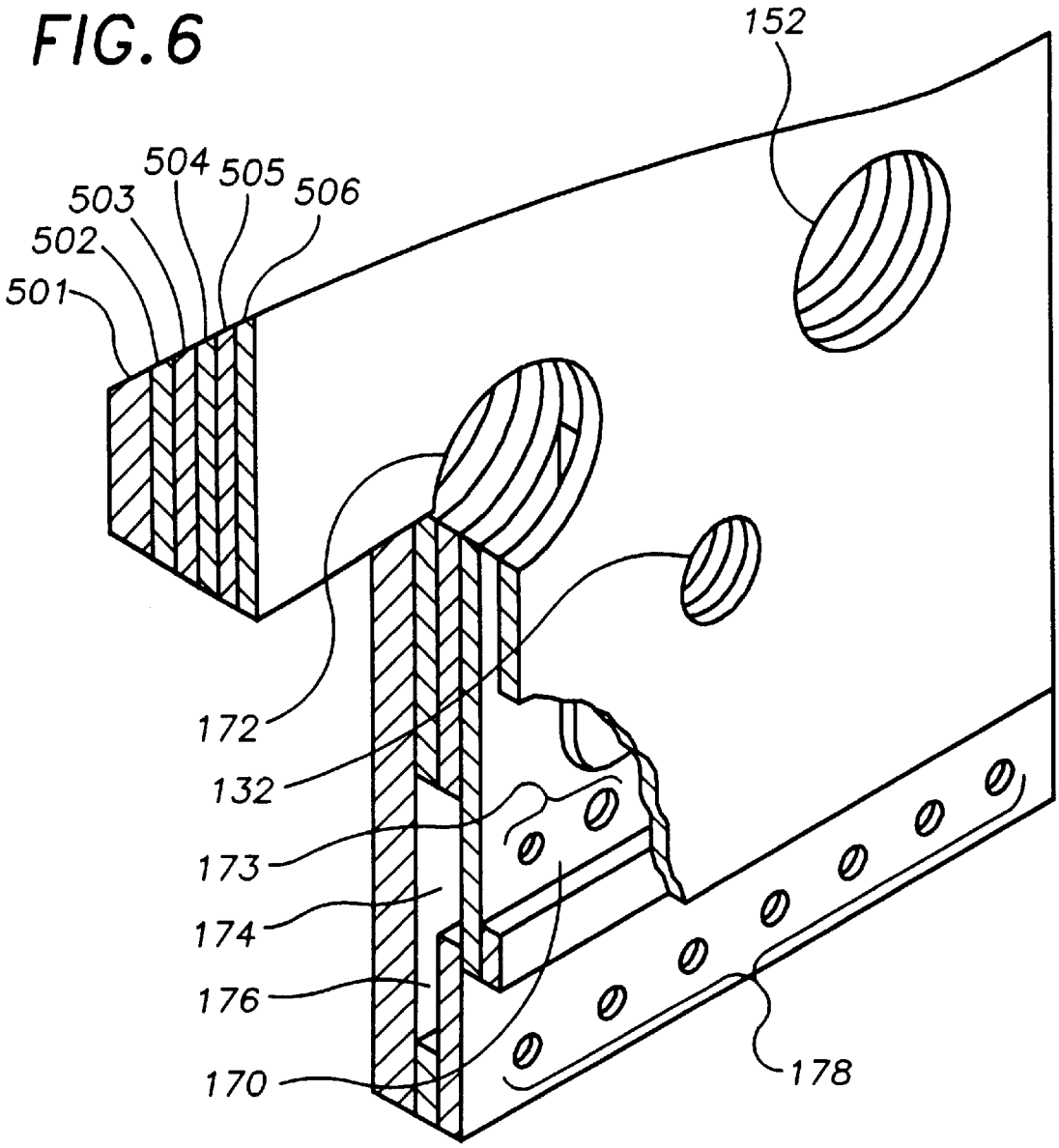
FIG. 6 is a partial perspective view of a portion of an exemplary die assembly comprising several individual plates of FIG. 3.

In the exemplary embodiments of FIGS. 3*a*–3*t* and 6, the die assembly 100 comprises a plurality of laminated members or plates, wherein the plates of FIGS. 3*b*–3*f* correspond to plates 502–506 in the partial die assembly of FIG. 6, respectively. According to this exemplary configuration, the third fluid is supplied from a third fluid inlet 172 extending through the plates of FIGS. 3*b*–3*e* into a first distribution cavity 170 in the plate of FIG. 3*e*, through a plurality of orifices 173 in the plate of FIG. 3*d*, into a cavity 174 in the plate of FIG. 3*c*, and into a cavity 176 in the plate of FIG. 3*b*. The fourth fluid is then supplied from the cavity 176 through a first plurality of orifices 178 in the plate of FIG. 3*c*, which orifices 178 form a first component of the converging third fluid flows. The third fluid also is supplied from the third fluid inlet 172 which continues to extend through the plates of FIGS. 3*e*–3*q* into a second distribution cavity 180 in the plate of FIG. 3*q*, into a plurality of orifices 183 in the plate of FIG. 3*r*, into a cavity 184 in the plate of FIG. 3*s*, and into a cavity 186 in the plate of FIG. 3*t*. The fourth fluid is then supplied from the cavity 186 through a second plurality of orifices 188 in the plate of FIG. 3*s*, which orifices 188 form a second component of the converging third fluid flows. The plurality of orifices 173 and 183 have various sizes, which compensate for pressure variations in the cavities 170 and 180 and uniformly distribute and supply the third fluid flow to the cavities 174 and 184, respectively. According to this configuration, the converging third fluid flows are dispensed from the respective or fices 178 and 188 at substantially the same mass flow rate. The third fluid mass flow rate through any one or more of the orifices 178 and 188, however, may be selectively varied as discussed above.

According to the exemplary embodiment, the first component of the converging third fluid flows emanates from the first plurality of orifices 178 and the second component of converging third fluid flows emanates from the second plurality of orifices 188 converge to form a high pressure zone proximate an output of each of the plurality of first orifices 110. The converging third fluid flows in this exemplary embodiment do not have a flow component in the flow direction of the first fluid flows, wherein the plurality of high pressure zones are useable to stem or block the flow of residual fluid from the plurality of first fluid orifices after terminating a first fluid supply to the first fluid inlet 132. In another application, the converging third fluid flows are useable to form separate first fluid flows as discussed above.

The exemplary embodiments of the die assembly 100 may be formed of a plurality of plates of substantially the same thickness, or alternatively, may be formed of a plurality of plates having different plate thicknesses, wherein each plate thickness is determined by the size of the conduits or cavities defined thereby as shown in FIGS. 3*a*–3*t*, 3*z*, 4*a*–4*f* and 5. The plates may be formed from metals, plastics, and ceramics among other materials, and the plates may be fabricated by stamping, punching, chemical etching, machining, and laser cutting among other processes, which are relatively cost effective alternatives to the prior art. Further, a die assembly 100 comprising a plurality of plates, as shown in the exemplary embodiments, provides considerable design flexibility in the configuration of the arrays or orifices, and the fluid flow and the distribution paths, which design and fabrication are not limited by the constraints imposed by prior art drilling processes. The plates of the present die assembly, for example, may be readily fabricated to produce die assemblies having configurations based on one or more of the exemplary configurations of FIG. 2*b*.

Figure 7:
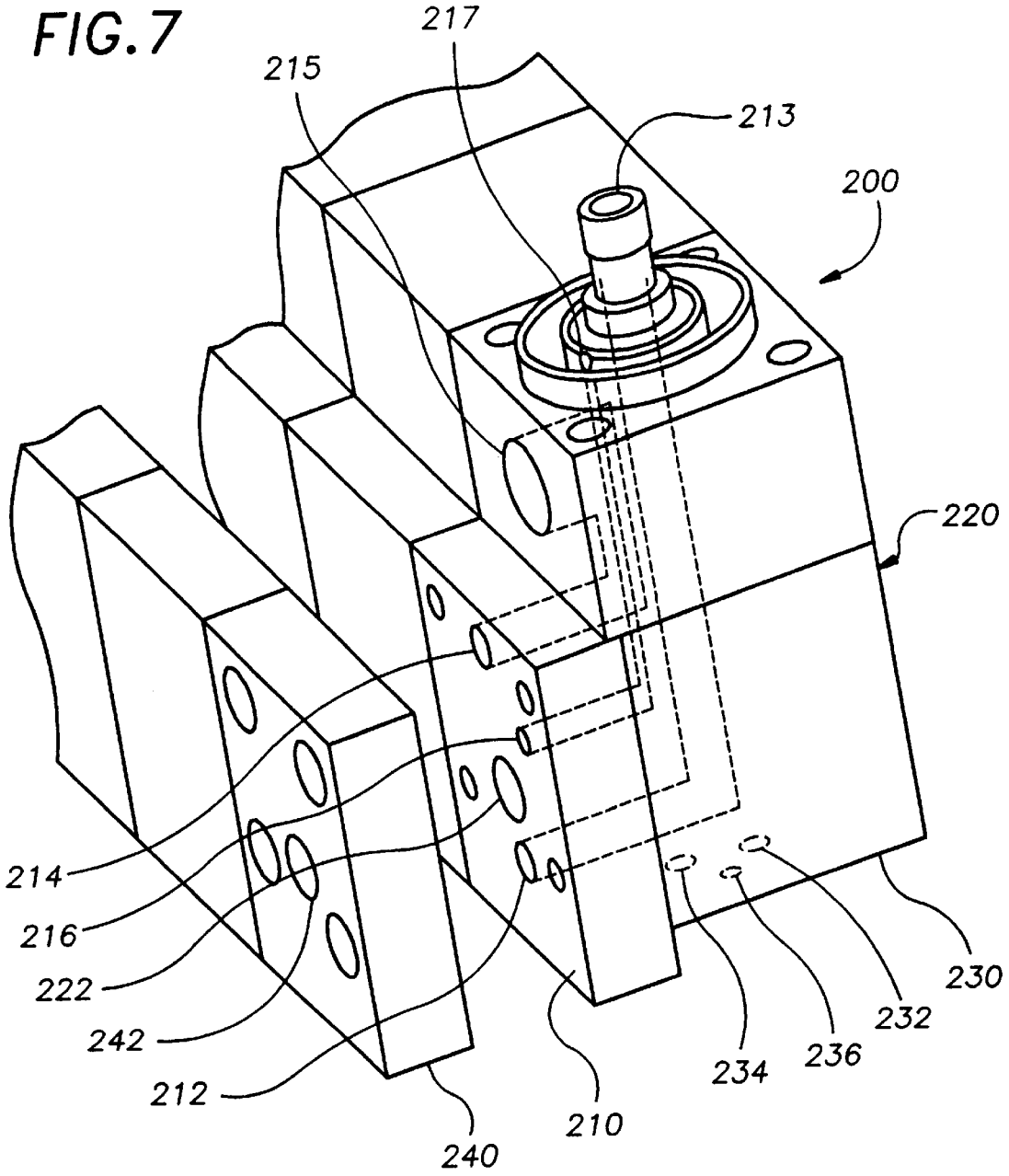
FIG. 7 represents a partial perspective view of an exemplary die adapter assembly for coupling with the exemplary die assemblies of FIGS. 3–5.

According to another aspect of the invention, the first and second fluids are supplied to the corresponding first and second fluid inlets 132 and 152 on a common fluid interface of the die assembly 100. FIG. 7 is an exemplary die adapter assembly 200 for mounting the die assembly 100 and for supplying fluids thereto. The die adapter assembly 200 includes a die assembly mounting interface 210 having a first fluid outlet port 212, a second fluid outlet port 214, and a control or third fluid outlet port 216, which are each coupled by corresponding conduits to corresponding fluid inlets ports 213, 215, and 217 on a body portion 220 of the adapter 200. In another embodiment, the die adapter assembly 200 includes a second interface 230 with a first fluid outlet port 232, a second fluid outlet port 234, and a control or third fluid outlet port 236, which are also coupled by corresponding conduit extensions, not shown, to corresponding fluid inlets ports 213, 215, and 217 on the body portion 220 of the adapter 200. The second mounting interface 230 is oriented at an angle relative to the first mounting interface 210, which in the exemplary embodiment is a 90 degree angle.

The die assembly 100 is coupled to the adapter 200 by mounting the die assembly 100 on the mounting interface 210 or 230. A sealing member like an o-ring, not shown, is disposed in a seat about each of the fluid outlets of the mounting interface 210 and 230 to provide a seal between the die assembly 100 and the adapter 200. The die assembly 100 and mounting interfaces 210 and 230 may also include mating alignment tabs to facilitate alignment and mounting of the die assembly 100 on the adapter 200. In one configuration, the die assembly 100 is mounted between the adapter interface 210 and a corresponding retaining plate 240, which retains the die assembly 100 mounted on the interface. A threaded bolt, not shown, is disposed through a central bore 232 of the retaining plate 230, and through a central bore of the die assembly 100, and into a threaded bore 222 of the body portion 220 of the adapter assembly 200, which permits ready installation and removal of the die assembly 100 relative to the adapter assembly 200. A similar retaining plate, not shown, is mounted on the unused mounting interface to seal the fluid outlet ports thereon. In another configuration, not shown, a second die assembly 100 is mounted on the second mounting interface so that the adapter 200 supplies fluids simultaneously to two die assemblies.

FIG. 3*a* is a die assembly fluid switching interface plate for diverting a single fluid flow to form either the second fluid flow or the third fluid flow as discussed above. The fluid flow switching plate includes a first fluid inlet 132, a switched fluid inlet 190, a primary fluid flow path 192 which couples the fluid inlet 190 with the third fluid inlet 172, and a secondary fluid flow path 194 which couples the fluid inlet 190 with the second fluid inlet 152. The primary fluid flow path 192 is a path of least resistance resulting from an asymmetry between the primary path 192 and the secondary path 194 so that fluid supplied to the fluid inlet 190 has a tendency to follow the curved primary fluid flow path 192 toward the third fluid inlet 172. The fluid from the fluid inlet 190 is diverted from the primary path 192 to the secondary path 194 by introducing an obstruction along the primary path 192, which causes the fluid to flow along the secondary path 194 toward the second fluid inlet 152. In the exemplary embodiment, the obstruction is a control air flow introduced from a control fluid inlet 193, which urges the switched fluid toward the secondary fluid flow path 194. The plate of FIG. 3*a* also includes a slot 195 with opposing end portions coupled by corresponding ports 196 and 197 in the plate of FIG. 3*b* to a recess 198 formed in the adjacent plates of FIGS. 3*c* and 3*d* for fluid pressure balancing. According to this configuration, the first fluid outlet 212, the second fluid outlet 214, and the control fluid outlet 216 of the die assembly adapter 200 are coupled, respectively, to the first fluid inlet 132, the switched fluid inlet 190, and the control fluid inlet 193 of the switching plate of FIG. 3*a* to supply fluid to the die assembly 100.

In one application, the die assembly adapter 200 is coupled to an MR-1300 nozzle module available from ITW Dynatec, Hendersonville, Tennessee, which includes a pneumatically actuatable valve for controlling the supply of first fluid to the first fluid inlet 213 of the die assembly adapter 200. The control air inlet 215 of the adapter 200 is coupled to the MR-1300 valve actuation air supply to supply control air to the control fluid inlet 193 of the die assembly 100, which directs fluid from the switched fluid inlet 190 to the fluid inlet 152 of the die assembly when the MR-1300 valve is opened to supply first fluid to the first fluid inlet 132 of the die assembly 100. According to this configuration, the first fluid and the second fluid supplied to the die assembly 100 are dispensed from the first and second orifices 110 and 120 as discussed above. And when the MR-1300 valve is closed to terminate the first fluid supply, control air to the control fluid inlet 193 of the die assembly 100 is terminated, wherein fluid from the switched fluid inlet 190 is directed to the fluid inlet 172 to form the converging air flows, which block first fluid from the first orifices as discussed above.

Figure 3Z:
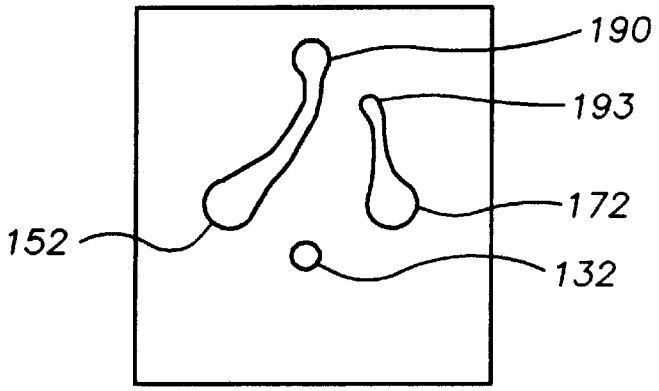
Figures 4A, 4B, 4C, 4D, 4E, 4F:
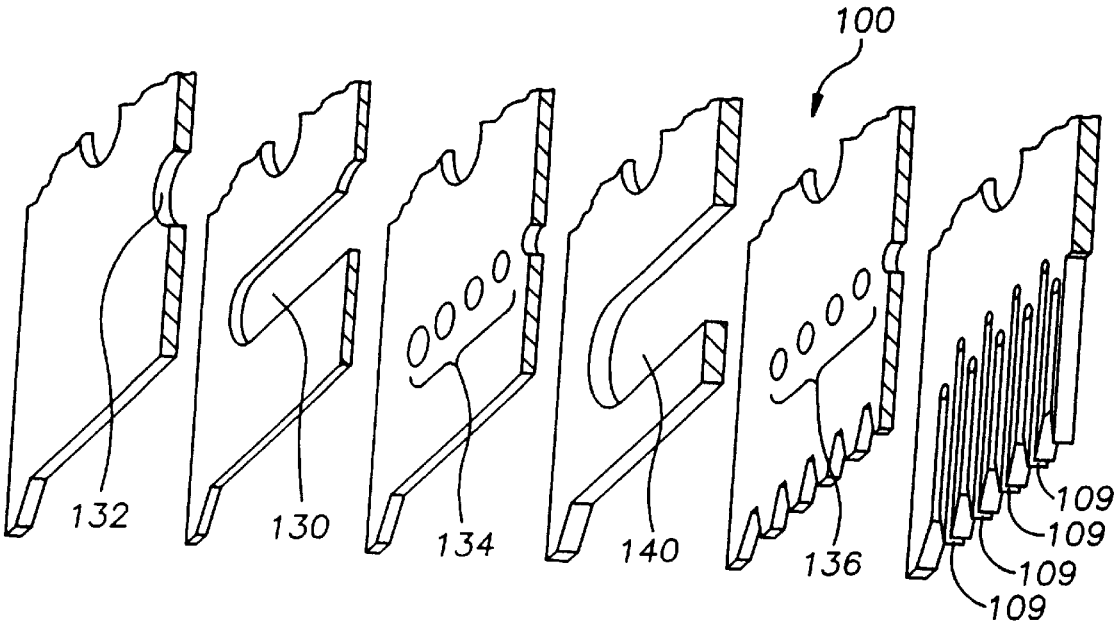
FIGS. 4*a*–4*f* represent a partial exploded view of an exemplary die assembly or body member comprising several individual plates of FIG. 3.

FIG. 3*z* is a die assembly fluid interface plate useable as an alternative to the die assembly fluid switching interface plate in FIG. 3*a*, wherein the fluid inlet 190 of the die assembly 100 is coupled directly to the second fluid inlet 152, and the fluid inlet 193 of the die assembly 100 is coupled directly to the third fluid inlet 172. According to this configuration, the control air inlet 215 of the adapter 200 is coupled to the MR-1300 valve actuation air supply to supply a control air to the fluid inlet 193 of the die assembly 100 when the MR-1300 valve is closed to terminate first fluid to the first fluid inlet 132 of the die assembly 100. This dedicated configuration provides more responsive residual first fluid flow blocking since there is no switching delay required to form the converging third fluid flows. The converging third fluid flows of the die assembly thus form high pressure zones in the presence of, but are unaffected by, the second fluid flows, which draw and attenuate the first fluid flows. In yet another configuration, the fluid supplied to the fluid inlet 193 is unrelated to the MR-1300 valve actuation air supply to provide still more control over the respective fluid flows.

According to another exemplary application, the meltblowing method and apparatus disclosed herein dispense meltblown adhesives onto substrates in manufacturing processes including the production of bodily fluid absorbing hygienic articles. According to a configuration for these applications, which is shown in FIG. 7, a plurality of at least two adjacent die assemblies 100 are disposed in corresponding die assembly adapters 200 arranged side by side to form a linear array of the plurality of corresponding adjacent first and second orifices 110 and 120 of each of the adjacent die assemblies 100. For meltblown adhesive dispensing applications, the first and second orifices of the die assembly have dimensions between approximately 0.001 and 0.030 inches on each side. These dimensions are not limiting however, and may be more or less for these and other applications. In one configuration, at least one of the endmost first orifices of the plurality of adjacent die assemblies has a modified first fluid flow vacillation to control the edge profile or edge definition of meltblown adhesive dispensed from the array of die assemblies according to the aspects and embodiments of the invention discussed above. In another configuration, the plurality of first orifices of the plurality of adjacent die assemblies are oriented to produce slightly diverging pluralities of first fluid flows, which provide a uniform meltblown adhesive application onto the substrates. And in another configuration, at least one or more of the plurality of first fluid flows are at different mass flow rates according to one or more configurations discussed above. The plates of the die assembly 100 may be assembled by soldering, brazing, mechanical clamping, fusion under high temperature and pressure, and adhesive bonding among other means.

While the foregoing written description of the invention enables anyone skilled in the art to make and use what is at present considered to be the best mode of the invention, it will be appreciated and understood by anyone skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. A meltblowing apparatus comprising:

a first fluid orifice in a body member; and exactly two second fluid orifices in the body member flanking the first fluid orifice on substantially opposing sides, wherein the first fluid orifice protrudes relative to the exactly two second fluid orifices and, wherein the exactly two second fluid orifices and the first fluid orifice have respective corresponding conduits disposed non-convergently in the body member.

2. The invention of claim 1, wherein the exactly two second fluid orifices and the first fluid orifice have respective corresponding conduits disposed in the body member in parallel.

3. A meltblowing apparatus comprising:

a first fluid orifice in a body member;

exactly two second fluid orifices in the body member flanking the first fluid orifice on substantially opposing sides, wherein the first fluid orifice protrudes relative to the exactly two second fluid orifices; and at least one additional first fluid orifice disposed in the body member along an axis passing through the first fluid orifice and the exactly two second fluid orifices.

4. The invention of claim 3, wherein the exactly two second fluid orifices and the first fluid orifice have respective corresponding conduits disposed in the body member in parallel.

5. The invention of claim 3, wherein the exactly two second fluid orifices and the first fluid orifice have respective corresponding conduits disposed non-convergently in the body member.

6. The invention of claim 3 further comprising at least one additional second fluid orifice disposed in the body member along the axis passing through the first fluid orifice and the exactly two second fluid orifices.

7. The invention of claim 3, wherein at least some of the first fluid orifices along the axis are flanked on substantially opposing sides by exactly two second fluid orifices.

8. A meltblowing apparatus comprising:

a body member having a plurality of first fluid orifices;

the body member having a plurality of second fluid orifices;

the plurality of first fluid orifices protruding relative to the plurality of second fluid orifices, each first fluid orifice flanked on substantially opposing sides by exactly two separate second fluid orifices, the plurality of first fluid orifices and the plurality of second fluid orifices formed by respective corresponding fluid conduits disposed non-convergently in the body member.

9. The apparatus of claim 8, at least some of the plurality of first and second fluid orifices aligned in a series.

10. The apparatus of claim 8, the fluid conduits disposed in parallel in the body member.

11. The apparatus of claim 8, the body member comprising a plurality of laminated members including at least two plates.

12. A meltblowing apparatus comprising:

a die assembly comprising a first orifice and two second orifices;

the first orifice in the die assembly including at least two parallel plates for dispensing a first fluid and forming a first fluid flow;

the two second orifices in the die assembly for dispensing a second fluid and forming two second fluid flows, the two second orifices flanking the first orifice on substantially opposing sides;

first and second opposing die retaining end plates for compressably retaining the die assembly therebetween; and an adapter having a first mounting interface for mounting the die assembly compressedly retained between the two opposing die retaining end plates.

13. In a meltblowing system that moves a substrate in a first direction, the improvement comprising:

a meltblowing apparatus positioned adjacent the moving substrate, the meltblowing apparatus comprising:

a first fluid orifice in a body member; and exactly two second fluid orifices in the body member flanking the first fluid orifice, the exactly two second fluid orifices flanking the first fluid orifice on substantially opposing sides along a direction non-parallel to the first direction.

14. The invention of claim 13, wherein the first fluid orifice protrudes relative to the exactly two second fluid orifices.

15. The invention of claim 13, wherein the exactly two second fluid orifices flank the first fluid orifice on substantially opposing sides in a direction substantially transverse to the first direction.

16. The invention of claim 13, wherein the exactly two second fluid orifices and the first fluid orifice have respective corresponding conduits disposed in the body member in parallel.

17. The invention of claim 13, wherein the exactly two second fluid orifices and the first fluid orifice have respective corresponding conduits disposed non-convergently in the body member.

18. A meltblowing method comprising:

forming a non-spiral filament adjacent a moving substrate;

vacillating the filament predominately non-parallel to a direction of the moving substrate; and depositing the filament onto the moving substrate.

19. The method of claim 18, vacillating the filament predominately transversely to the direction of the moving substrate.

20. The method of claim 18, vacillating the filament substantially periodically.

21. The method of claim 18, increasing a vacillation amplitude of the filament as the filament approaches the moving substrate.

22. The method of claim 18, vacillating the filament predominately between two separate second fluid flows directed non-convergently along substantially opposing sides of the filament.

23. The method of claim 18, forming the filament from a first fluid flow drawn by two separate second fluid flows directed non-convergently along substantially opposing sides of the first fluid flow, and vacillating the filament predominately between the two second fluid flows along substantially opposing sides thereof.

24. The method of claim 23, forming the first fluid flow with a first fluid dispensed from a first orifice, forming the two second fluid flows with a second fluid dispensed from corresponding separate second orifices disposed on substantially opposing sides of the first orifice, the first orifice protruding relative to the second orifices, the first and second orifices aligned non-parallel to the direction of the moving substrate.

25. The method of claim 24, vacillating the filament predominately transversely to the direction of the moving substrate, the first and second orifices aligned substantially transversely to the direction of the moving substrate.

26. The method of claim 18, forming a plurality of filaments adjacent the moving substrate, vacillating at least some of the plurality of filaments predominately non-parallel to the direction of the moving substrate, and depositing the plurality of filaments onto the moving substrate.

27. The method of claim 26, vacillating at least some of the plurality of filaments predominately transversely to the direction of the moving substrate.

28. The method of claim 26, vacillating at least some of the plurality of filaments substantially periodically.

29. The method of claim 26, increasing a vacillation amplitude of at least some of the plurality of filaments as the filaments approach the moving substrate.

30. The method of claim 26, vacillating the plurality of filaments predominately between two separate second fluid flows directed non-convergently along substantially opposing sides of each filament.

31. The method of claim 26, forming the plurality of filaments from a corresponding plurality of first fluid flows each drawn by two separate second fluid flows directed non-convergently along substantially opposing sides thereof, and vacillating the plurality of filaments predominately between the two second fluid flows along opposing sides of each filament.

32. The method of claim 31, forming the first fluid flows with a first fluid dispensed from a corresponding plurality of first orifices, forming the second fluid flows with a second fluid dispensed from a corresponding plurality of second orifices, the plurality of first orifices each flanked on substantially opposing sides by two separate second orifices, the plurality of first orifices protruding relative to the plurality of second orifices, at least some of the plurality of first and second orifices aligned non-parallel to the direction of the moving substrate.

33. The method of claim 32, vacillating at least some of the filaments predominately transversely to the direction of the moving substrate, at least some of the plurality of first and second orifices aligned substantially transversely to the direction of the moving substrate.

34. A meltblowing method comprising:

forming a filament from a first fluid flow drawn by two separate second fluid flows directed non-convergently along substantially opposing sides of the first fluid flow; and vacillating the filament substantially periodically and predominately between the two second fluid flows along substantially opposing sides thereof.

35. The method of claim 34, directing the second fluid flows in parallel with the first fluid flow.

36. The method of claim 34, depositing the filament onto a substrate moving substantially transversely to a predominant vacillation amplitude of the filament.

37. The method of claim 34, depositing the filament onto a substrate moving non-parallel to a predominant vacillation amplitude of the filament.

38. The method of claim 34, forming the first fluid flow with a first fluid dispensed from a first orifice, and forming the two second fluid flows with a second fluid dispensed from corresponding separate second orifices disposed on substantially opposing sides of the first orifice, the first orifice protruding relative to the second orifices.

39. The method of claim 34, forming a plurality of filaments from a corresponding plurality of first fluid flows each drawn by two separate second fluid flows directed non-convergently along substantially opposing sides thereof, and vacillating the plurality of filaments predominately between the two second fluid flows along substantially opposing sides of the filament.

40. The method of claim 39, directing, at least some of the plurality of second fluid flows in parallel with at least some of the first fluid flows.

41. The method of claim 39, depositing the plurality of filaments onto a substrate moving substantially transversely to a predominant vacillation amplitude of at least some of the plurality of filaments.

42. The method of claim 39, depositing the plurality of filaments onto a substrate moving non-parallel to a predominant vacillation amplitude of at least some of the plurality of filaments.

43. The method of claim 39, forming the plurality of first fluid flows with a first fluid dispensed from a corresponding plurality of first orifices, forming the plurality of second fluid flows with a second fluid dispensed from a corresponding plurality of second orifices, the plurality of first orifices each flanked on substantially opposing sides by two separate second orifices, the plurality of first orifices protruding relative to the plurality of second orifices.

44. A meltblowing method comprising:

(a) forming a first fluid flow;

(b) forming exactly two second fluid flows on substantially opposing flanking sides of the first fluid flow;

(c) with the exactly two second fluid flows, drawing the first fluid flow into a first filament;

(d) moving a substrate in a direction non-parallel to an axis passing transversely through the first and second fluid flows; and (e) depositing the first fluid filament onto the moving substrate.

45. The invention of claim 44 further comprising vacillating the first filament in a direction non-parallel to the direction of the moving substrate.

46. The invention of claim 44, wherein the first filament has a diameter of less than about 20 microns.

47. The invention of claim 44, wherein the first filament has a diameter of between about 2 microns and about 4 microns.

48. The invention of claim 44, wherein the first filament has a diameter of less than about 80 microns.

49. The invention of claim 44, wherein (d) comprises moving a substrate in a direction substantially transverse to an axis passing transversely through the first and second fluid flows.

50. The invention of claim 44, wherein (b) comprises directing the first fluid flow parallel to the exactly two second fluid flows.

51. A meltblowing method comprising:

(a) dispensing a first fluid from a plurality of first orifices at equal mass flow rates to form a plurality of first fluid flows at a first velocity;

(b) dispensing a second fluid from a plurality of second orifices to form a plurality of second fluid flows at a second velocity, the plurality of first fluid flows and the plurality of second fluid flows arranged in a series so that each of the plurality of first fluid flows is flanked on substantially opposing sides by corresponding second fluid flows;

(c) drawing the plurality of first fluid flows with the plurality of second fluid flows at a second velocity greater than the first velocity of the plurality of first fluid flows; and (d) non-convergently directing the plurality first fluid flows and the plurality of second fluid flows.

52. A meltblowing apparatus comprising:

a first fluid orifice in a die assembly including at least two parallel plates;

two second fluid orifices in the die assembly associated with the first fluid orifice;

the first fluid orifice protruding relative to the second fluid orifices, and the first and second fluid orifices formed in at least one of the two parallel plates of the die assembly.

53. The apparatus of claim 52, one of the second fluid orifices is disposed on one side of the first fluid orifice and another of the second fluid orifices is disposed on another substantially opposite side of the first fluid orifice.

54. The apparatus of claim 53, the first and second fluid orifices each have a corresponding fluid conduit formed in the die assembly, the fluid conduits of the first and second fluid orifices are arranged non-convergently.

* * * * *